US006917350B2

(12) United States Patent
Pae et al.

(10) Patent No.: US 6,917,350 B2
(45) Date of Patent: Jul. 12, 2005

(54) DRIVING CIRCUIT OF ACTIVE MATRIX METHOD IN DISPLAY DEVICE

(75) Inventors: Han Su Pae, Taegu-shi (KR); Young Sun Na, Seoul (KR); Oh Kyong Kwon, Seoul (KR); Hak Su Kim, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 577 days.

(21) Appl. No.: 10/033,979

(22) Filed: Jan. 3, 2002

(65) Prior Publication Data

US 2002/0089357 A1 Jul. 11, 2002

(30) Foreign Application Priority Data

Jan. 5, 2001 (KR) ..... 2001-625

(51) Int. Cl.[7] ..... G09G 3/20

(52) U.S. Cl. ..... 345/55; 345/76; 345/78; 345/204

(58) Field of Search ..... 345/76, 77, 78, 345/79, 80, 82, 204, 55; 315/169.3

(56) References Cited

U.S. PATENT DOCUMENTS 5,952,789 A * 9/1999 Stewart et al. ..... 315/169.4
6,229,506 B1 * 5/2001 Dawson et al. ..... 345/82
6,307,322 B1 * 10/2001 Dawson et al. ..... 315/169.1
6,384,804 B1 * 5/2002 Dodabalapur et al. ..... 345/82
6,501,449 B1 * 12/2002 Huang ..... 345/82

FOREIGN PATENT DOCUMENTS

| | | |
|---|---|---|
| EP | 0 905 673 A | 3/1999 |
| EP | 1 003 150 A | 5/2000 |
| JP | 6-067152 | 3/1994 |
| JP | 2000-267622 | 9/2000 |
| WO | WO 99 65012 A | 12/1999 |

OTHER PUBLICATIONS

Dawson R. M. A., et al., "The Impact of the Transient Response of Organic Light Emitting Diodes on the Design of Active Matrix OLED Displays," Electron Devices Meeting, 1998, IDEM '98 Technical Digest, International San Francisco, CA, Dec. 6–9, 1998, Piscataway, NJ, IEEE, pp. 875–878.

* cited by examiner

*Primary Examiner*—Albert Decady
*Assistant Examiner*—Fritz Alphonse
(74) *Attorney, Agent, or Firm*—Fleshner & Kim, LLP

(57) ABSTRACT

A driving circuit of an active matrix method in a display device is disclosed, which can compensate luminance deviation of the display device according to threshold voltage deviation of a driving unit. The driving circuit of the active matrix method includes a switching unit switching a current applied from the driving unit to the display device, and a deviation compensator detecting the current applied to the display device by switching of a second switch, and controlling a control voltage, thereby compensating luminance deviation of the display device according to threshold voltage deviation of the driving unit.

18 Claims, 6 Drawing Sheets

T1 : Hold Time
T2 : Data Clear Time
T3 : Data Decision Time
T4 : 1 Line Time
T5 : 1 Frame Time T1 : Hold Time
T2 : Data Clear Time
T3 : Data Decision Time
T4 : 1 Line Time
T5 : 1 Frame Time t1 : Iout Reset Time
t2 : Data Reset Time
t3 : Data Writing Time
t4 : One Scan Time
t5 : One Frame Time

DRIVING CIRCUIT OF ACTIVE MATRIX METHOD IN DISPLAY DEVICE

This application claims the benefit of the Korean Application No. P2001-00625 filed on Jan. 5, 2001, which is hereby incorporated by reference.

BACKGROUND OF THE INVENTION

1. Field of the Invention

The present invention relates to a driving circuit of an active matrix method in a display device.

2. Discussion of the Related Art

Recently, various display devices such as an LCD device, a PDP device, an FED device and an EL device have been studied with development of flat display devices. These flat display devices are classified into two according to a driving method, a passive matrix method and an active matrix method. At this time, it is required to use a higher level of current in the passive matrix method than the active matrix method.

Accordingly, in current driving methods of the LCD device and the PDP device, since greater current level is required with increasing the number of pixel, the passive matrix method is more efficient.

Meanwhile, in current driving methods of the FED and EL devices, it is regarded that the active matrix method is more efficient than the passive matrix method since it is required to use the higher level of current in the passive matrix method than the active matrix method even though a line time is equal.

FIG. 1 is a circuit diagram of a driving circuit according to a related art active matrix method.

As shown in FIG. 1, the driving circuit includes a scan line SEL, a data line DATA, a switch P1, a capacitor Cs, a driving transistor PO, an OEL and a positive power supply VDD.

At this time, the scan line SEL selects a pixel for driving, and the data line DATA applies a voltage to the pixel. The switch P1 is served as an active device to control data input according to a signal of the scan line, and the capacitor Cs stores electric charges selected according to the voltage applied to the data line. Next, a voltage is input to the driving transistor PO by the electric charges stored in the capacitor Cs, and then the driving transistor PO applies a current to the OEL. The OEL emits light by the current applied from the driving transistor PO, and the positive power supply VDD supplies a power to the capacitor Cs and the driving transistor PO.

An operation of an active matrix method in a related art display device will be described in detail.

First, the pixel driven by the scan line SEL is selected, and then the pixel for driving is turned on by the switch P1. Then, a control voltage, in which a gray is controlled, is applied to the pixel for driving through the data line.

At this time, the control voltage stored in the capacitor Cs, simultaneously, drives the driving transistor PO to make the GEL emit lights.

After the scan line is disabled, the driving transistor PO is driven by the voltage stored in the capacitor Cs to maintain one frame until the next select time.

However, since threshold voltages of the driving transistors used in the display device are different, the driving current for driving the OEL selected is not constant even though an equal driving voltage is applied to each driving transistor.

That is, each OEL emits different luminance according to deviation of the threshold voltages of the driving transistors.

To decrease the luminance deviation of the OEL according to the deviation of the threshold voltages of the driving transistors, it is required to constantly apply the driving current for driving the OEL without regard to the deviation of the threshold voltages of each driving transistor.

The deviation of the threshold voltages of the driving transistors is necessary consequence in fabricating process steps of the display device. Therefore, the luminance deviation of the pixels has to be compensated by detecting luminance of each pixel, however, it is hard to effectively compensate the luminance deviation.

Also, in the related art driving circuit, if a margin of the control voltage according to level of the driving current is small, it is hard to obtain desired luminance.

SUMMARY OF THE INVENTION

Accordingly, the present invention is directed to a driving circuit of an active matrix method in a display device that substantially obviates one or more problems due to limitations and disadvantages of the related art.

An object of the present invention is to provide a driving circuit of an active matrix method in a display device that can constantly improve luminance between pixels.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving circuit of an active matrix method in a display device according to the present invention includes a first switch connected data and scan lines to switch an externally applied control voltage, a driving unit storing the control voltage by switching of the first switch, and making the display device emitting lights by the stored control voltage, a second switch switching a current applied to the display device by the control voltage applied from the driving unit, and a deviation compensator detecting the current applied to the display device by switching of the second switch, and controlling the control voltage, thereby compensating luminance deviation of the display device according to deviation of the threshold voltages of the driving unit.

The deviation compensator includes a converter converting the current applied to the display device to a voltage, or a transimpedance amplifier converting the current applied to the display device to a voltage amplified, a comparator comparing the converted voltage value with a reference voltage value, and a sample & hold circuit (S & H circuit) receiving an external ramp voltage, and outputting a certain ramp voltage to the data line according to result of the comparator.

The S & H circuit outputs the ramp voltage value constantly maintained to the data line when the converted voltage value is same as or lower than the reference voltage value, and the S & H circuit bypasses and outputs the external input ramp voltage value to the data line when the converted voltage value is higher than the reference voltage value.

An amplifier formed between the second switch and the deviation compensator amplifies the applied current by switching of the second switch, and inputs the amplified current to the deviation compensator.

In another embodiment of the present invention, a driving circuit of an active matrix method in a display device according to the present invention includes a switching unit connected to data and scan lines to switch an externally applied control voltage, a driving unit storing the control signal by switching of the switching unit, and making the display device emit lights by the voltage stored, a deviation compensator detecting a current applied to the display device, and controlling the control voltage, thereby compensating luminance deviation of the display device according to deviation of threshold voltages of the driving unit, a first transistor formed between the driving unit and the display device to switch the current applied to the display device, and a second transistor formed between the driving unit and the deviation compensator to switch the current applied to the deviation compensator.

The switching unit, the first and second transistors are PMOS transistors, and are respectively driven by different control signals, or the switching unit and the second transistor are PMOS transistors, and the first transistor is NMOS transistor, the switching unit, the first and second transistors driven by an equal control signal.

An amplifier formed between the second transistor and the deviation compensator amplifies the applied current by switching of the second transistor, and inputs the amplified current to the deviation compensator.

The amplifier includes a third transistor having a gate connected to an output terminal of the second transistor to output the current amplified by a voltage difference between gate and source to the deviation compensator, and a fourth transistor connected to gate and ground of the third transistor, and controlling the voltage difference by an externally applied control signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
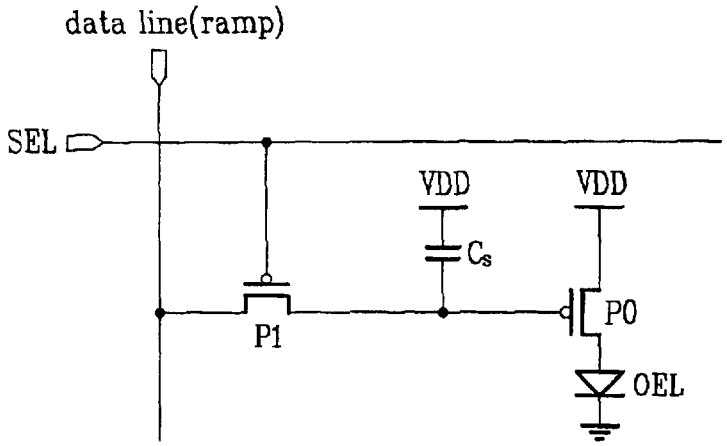
FIG.1 Related Art
FIG. 1 is a circuit diagram of a driving circuit according to a related art active matrix method.
Figure 2:
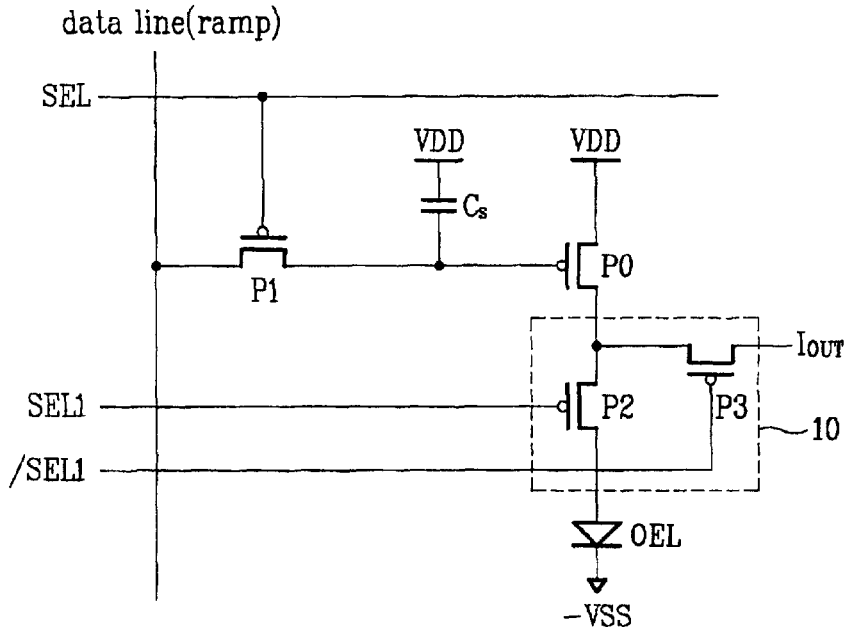
FIG. 2 is a circuit diagram of a driving circuit in an active matrix method according to the first embodiment of the present invention.
Figure 3:
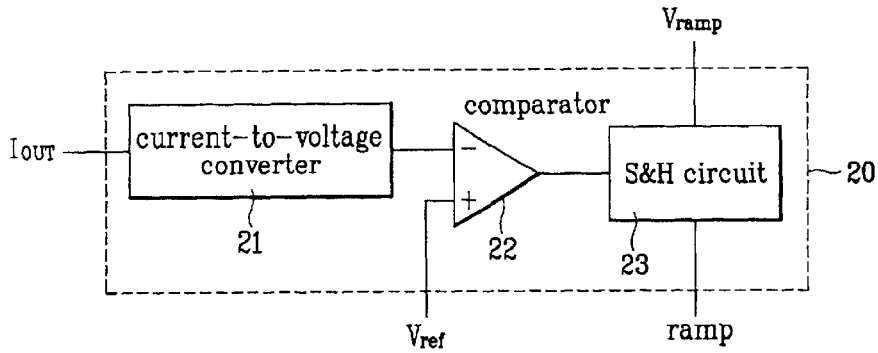
FIG. 3 is a block diagram illustrating a deviation compensator of a driving circuit according to the present invention.

FIG. 2 is a circuit diagram of a driving circuit in an active matrix method according to the first embodiment of the present invention, and FIG. 3 is a block diagram illustrating a deviation compensator of the driving circuit according to the present invention.

As shown in FIG. 2 and FIG. 3, the driving circuit includes a transistor P1, a capacitor Cs, a driving transistor PO and a positive power supply VDD.

At this time, the transistor P1 connected to data and scan lines switches an externally applied control voltage, and the capacitor Cs stores the control voltage by switching of the transistor P1. Next, the driving transistor PO makes an emitting pixel OEL emit lights by the control voltage applied from the capacitor Cs, and the positive power supply VDD supplies a power to the capacitor Cs and the driving transistor PO.

Also, the driving circuit further includes a switching unit 10 and a deviation compensator 20. The switching unit 10 connected between the driving transistor PO and the emitting pixel OEL switches a current applied to the emitting pixel OEL according to a voltage applied from the driving transistor PO. Also, the deviation compensator 20 detects the current applied to the emitting pixel OEL by switching of the switching unit 10, and controls the control voltage, so that luminance deviation of the emitting pixel OEL generated from threshold voltage deviation of the driving transistor PO is compensated.

At this time, the switching unit 10 includes a transistor P2 switching the current applied to the emitting pixel OEL by a control signal SEL1, and a transistor P3 switching the current applied to the deviation compensator 20 by a control signal SEL1.

The transistors P1, P2 and P3 are PMOS transistors, and are driven by different control signals.

That is, the transistor P1 is driven by the control signal SEL, the transistor P2 is driven by the control signal SEL1, and the transistor P3 is driven by the control signal/SEL1.

As described above, in the present invention, the driving transistor PO is connected to the emitting pixel OEL by the transistor P2 unlike the related art in which the driving transistor PO is directly connected to the emitting pixel OEL.

As shown in FIG. 3, the deviation compensator 20 for compensating the luminance deviation of the emitting pixel OEL includes a current-to-voltage converter (I-to-V converter) 21, a comparator 22, and a sample & hold circuit (S & H circuit) 23. The current-to-voltage converter detects a driving current $I_{out}$ from the transistor P3 and converts the detected driving current to a voltage. The comparator 22 compares the voltage converted by the I-to-V converter 21 with a reference voltage Vref that is set to make the emitting pixel OEL emit lights at a predetermined luminance. To the sample & hold circuit 23, an external ramp voltage is applied. The sample & hold circuit 23 outputs a certain ramp voltage value to the data line according to result of the comparator 22.

At this time, the sample & hold circuit 23 constantly maintains the ramp voltage Vramp externally input at a point that the converted voltage value is same as the reference voltage value, and outputs the ramp voltage value constantly maintained to the data line.

Meanwhile, when the converted voltage value is higher than the reference voltage value, the externally input ramp voltage value Vramp is bypassed and is output to the data line.

Figure 4:
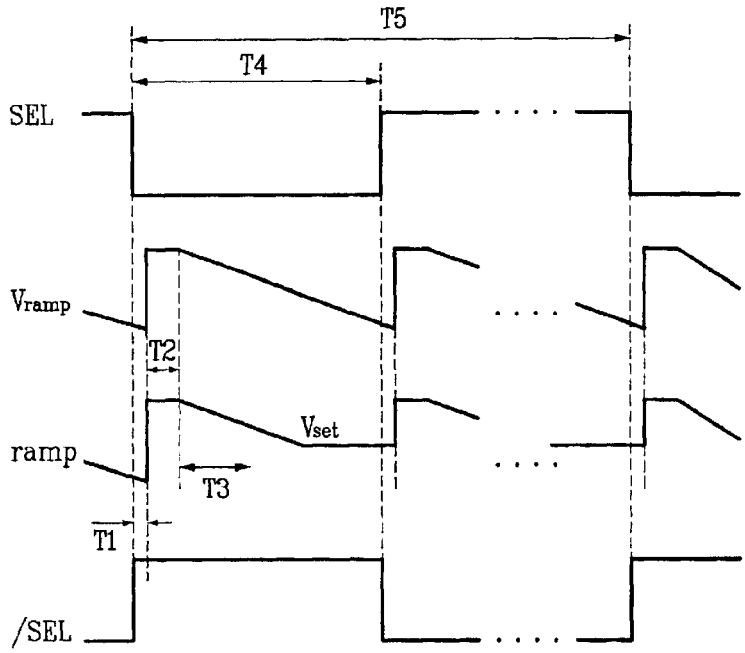
FIG. 4 is a timing view illustrating each signal waveform according to the first embodiment of the present invention.

FIG. 4 is a timing view illustrating each signal waveform according to the first embodiment of the present invention.

As shown in FIG. 4, if the emitting pixel GEL is selected by the control signal SEL, the transistors P1 and P2 are turned off simultaneously, and the transistor P3 is turned on by the control signal /SEL1.

At this time, the ramp voltage input through the data line drives the driving transistor PO by the transistor P1, and the deviation compensator 20 detects the driving current of the emitting pixel OEL by the transistor P3.

Referring to FIG. 3, the detected driving current is converted to the voltage by the current-to-voltage converter 21, and then the converted voltage is compared with the reference voltage by the comparator 22.

According to result of the comparator 22, the sample & hold circuit 23 bypasses and continuously outputs the externally input ramp voltage Vramp to the data line until the converted voltage value is same as the reference voltage value.

If the converted voltage value is same as or lower than the reference voltage value, the sample & hold circuit 23 constantly maintains the ramp voltage Vramp externally input at a point that the converted voltage value becomes same as the reference voltage value, and outputs the ramp voltage value constantly maintained to the data line.

At this time, the ramp voltage value constantly maintained is continuously output to the data line from a point that the converted voltage value becomes same as the reference voltage value to a point that the converted voltage value is higher than the reference voltage value.

The ramp voltage value Vramp constantly maintained is higher than the threshold voltage value of the driving transistor that drives the emitting pixel OEL, so that it is possible to solve a problem of the luminance deviation of the emitting pixel OEL according to the threshold voltage deviation of the driving transistor.

Subsequently, the ramp voltage value Vramp constantly maintained is stored in the capacitor Cs for storing electric charges by the data line.

Next, if corresponding emitting pixel OEL is selected by the control signal SEL, the transistors P1 and P2 are turned on, simultaneously, the transistor P3 is turned off by the control signal/SEL1.

Accordingly, the driving transistor PO of the corresponding emitting pixel OEL is driven by the capacitor Cs for storing the electric charges, and then the emitting pixels OEL emit lights by the driving current applied by the transistor P2 at a constant luminance.

As described above, the deviation compensator of the present invention outputs the ramp voltage value constantly maintained to the data line during a time period 'T1' (hold time), so that it is possible to solve a problem generated by luminance deviation of the emitting pixels OEL according to the threshold voltage deviation of the driving transistors.

Referring to FIG. 3, in the deviation compensator of the present invention, an amplifier having a high transimpedance value may be used instead of the current-to-voltage converter 21.

In the related art driving circuit, if a margin of the control voltage according to a level of the driving current is small, it is hard to obtain desired luminance.

However, if the amplifier having the high transimpedance is used in the present invention, it is possible to obtain desired luminance since a margin of the control voltage according to a level of the driving current can be increased.

In another embodiment of the present invention, each switching device uses the scan line in common, thereby decreasing an area of the driving circuit, and increasing an emitting area.

Figure 5:
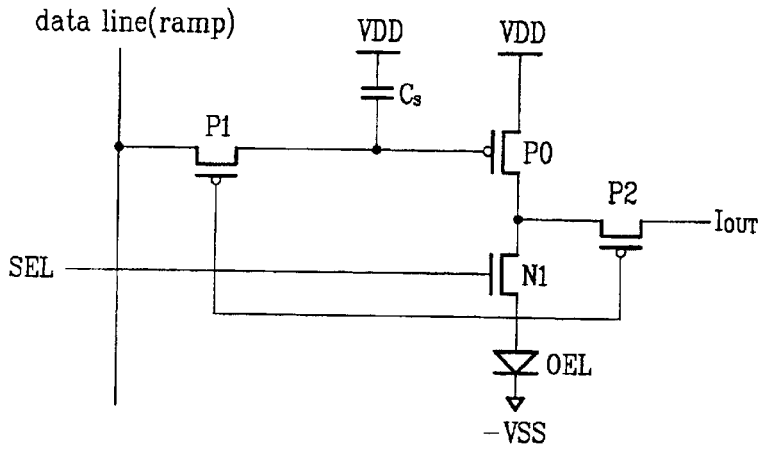
FIG. 5 is a circuit diagram of a driving circuit in an active matrix method according to the second embodiment of the present invention.
Figure 6:
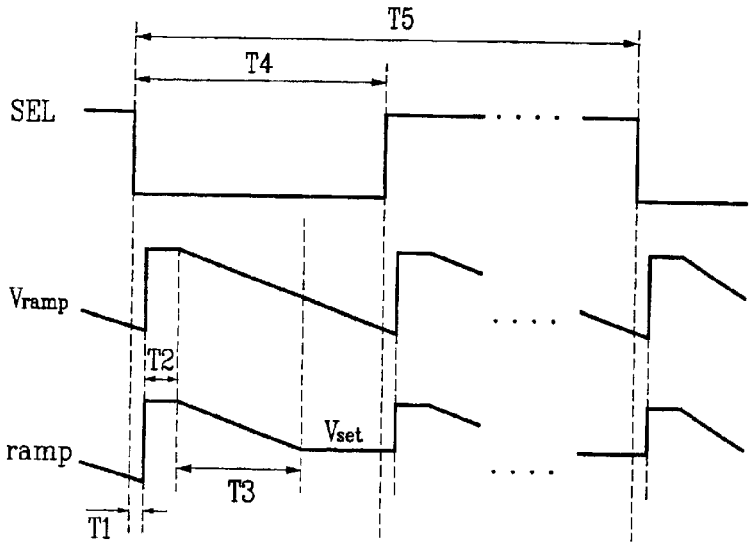
FIG. 6 is a timing view illustrating each signal waveform according to the second embodiment of the present invention.

FIG. 5 is a circuit diagram of a driving circuit in an active matrix method according to the second embodiment of the present invention, and FIG. 6 is a timing view illustrating each signal waveform according to the second embodiment of the present invention.

As shown in FIG. 5, the second embodiment of the present invention is different to the first embodiment of the present invention in that a driving transistor PO is connected to a NMOS transistor N1, and NMOS transistor N1 and PMOS transistors P1 and P2 are controlled by an equal control signal SEL.

In the second embodiment of the present invention, the NMOS transistor N1 is used, so that it is not required to additionally apply a control signal applied to the transistor N1. That is, since the transistors P1 and P2 are conversely switched, the control signal SEL can control not only the PMOS transistors P1 and P2 but also the NMOS transistor N1.

Referring to FIG. 5 and FIG. 6, an operation of the driving circuit will be described in detail.

If corresponding emitting pixel OEL is selected by the control signal SEL, the transistors P1 and P2 are respectively turned on, simultaneously, and the transistor N1 is turned off.

At this time, a ramp voltage input by a data line drives the driving transistor PO by the transistor P1, and a deviation compensator 20 detects a driving current of an emitting pixel OEL by the transistor P2.

Referring to FIG. 3 and FIG. 4, the deviation compensator 20 outputs the ramp voltage Vramp to the data line by the equal process, and the ramp voltage Vramp is stored in a capacitor Cs for storing electric charges by the data line.

Next, if the corresponding emitting pixel OEL is selected by the control signal SEL, the transistors P1 and P2 are respectively turned off, simultaneously, and the transistor N1 is turned on.

Then, the driving transistor PO of the corresponding emitting pixel OEL is driven by the capacitor Cs for storing the electric charges, and the emitting pixels OEL emit lights at a constant luminance by the driving current applied by the transistor N1.

The other embodiment of the present invention will be described with reference to the accompanying drawings.

Figure 7:
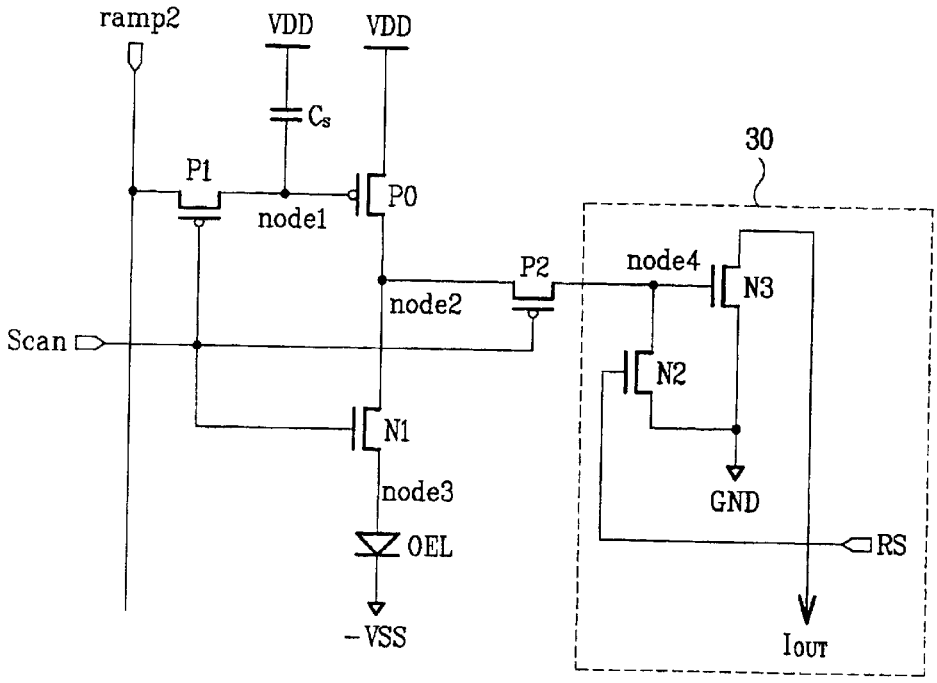
FIG. 7 is a circuit diagram of a driving circuit in an active matrix method according to the third embodiment of the present invention.
Figure 8:
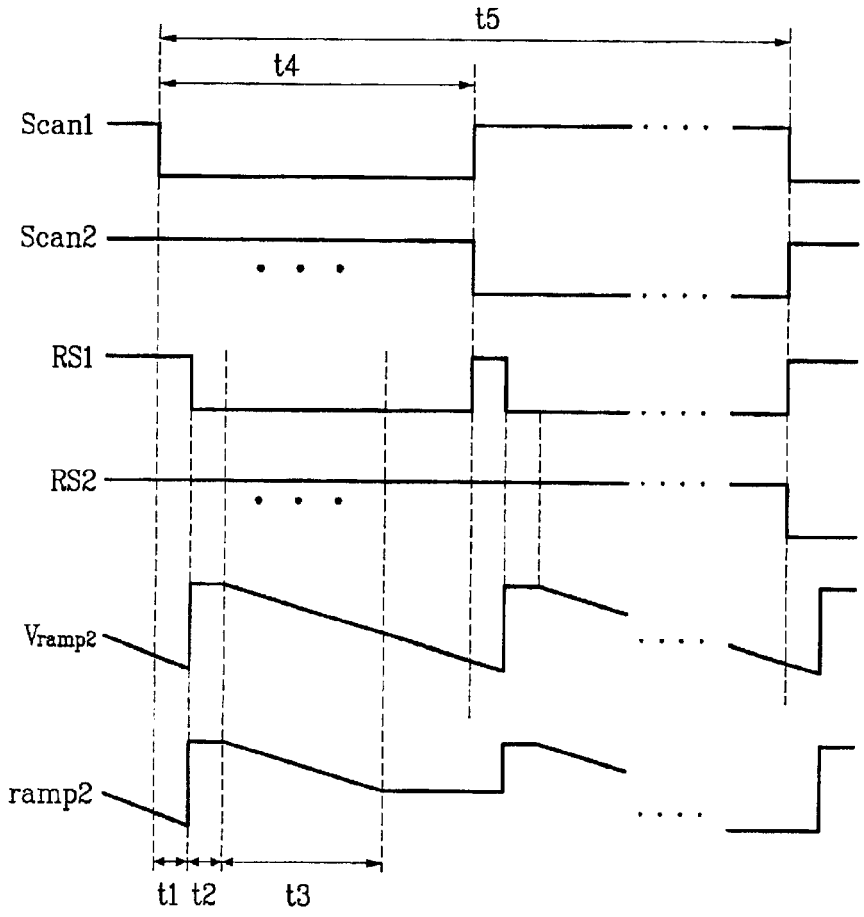
FIG. 8 is a timing view illustrating each signal waveform according to the third embodiment of the present invention.

FIG. 7 is a circuit diagram of a driving circuit in an active matrix method according to the third embodiment of the present invention, and FIG. 8 is a timing view illustrating each signal waveform according to the third embodiment of the present invention.

Referring to FIG. 7, the third embodiment of the present invention is different to the first embodiment of the present invention in that a NMOS transistor N1 is formed between a node 2 and a node 3, and an amplifier 30 is formed between a transistor P2 and a deviation compensator 20.

At this time, the amplifier 30 amplifies a current applied by the transistor P2, and then input the current to the deviation compensator.

The amplifier 30 includes NMOS transistors N2 and N3.

A gate of the NMOS transistor N3 is connected to an output terminal of the transistor P2, and the NMOS transistor N3 outputs the amplified current to the deviation compensator by a voltage difference between gate and source.

The NMOS transistor N2 is respectively connected to gate and ground of the transistor N3, and controls the voltage difference between the gate and the source of the transistor N2 by an externally applied control signal.

The embodiment of the present invention includes the amplifier 30 since it is hard to detect a current level of $I_{out}$ in the deviation compensator if the current level of $I_{out}$ is low referring to FIG. 2 and FIG. 5.

Accordingly, in the third embodiment of the present invention, the transistors N2 and N3 are additionally formed to amplify the current level of $I_{out}$.

As shown in FIG. 7, if the electric charges are stored in parasitic capacitance of a node 4, and Vgs (voltage between the gate and source) of the transistor N3 is increased, the amplified $I_{out}$ is output.

The driving circuit according to the third embodiment of the present invention has the following advantages.

First, the NMOS transistor N1 of FIG. 7 uses P-well of the transistors N2 and N3 in common with the transistors N2 and N3, thereby decreasing an area of layout.

Next, in case that a negative voltage is applied to the node 3, the NMOS transistor N1 of FIG. 7 maintains the node 3 at a voltage higher than −0.7V, thereby preventing the driving transistor PO from being over loaded.

Figure 9:
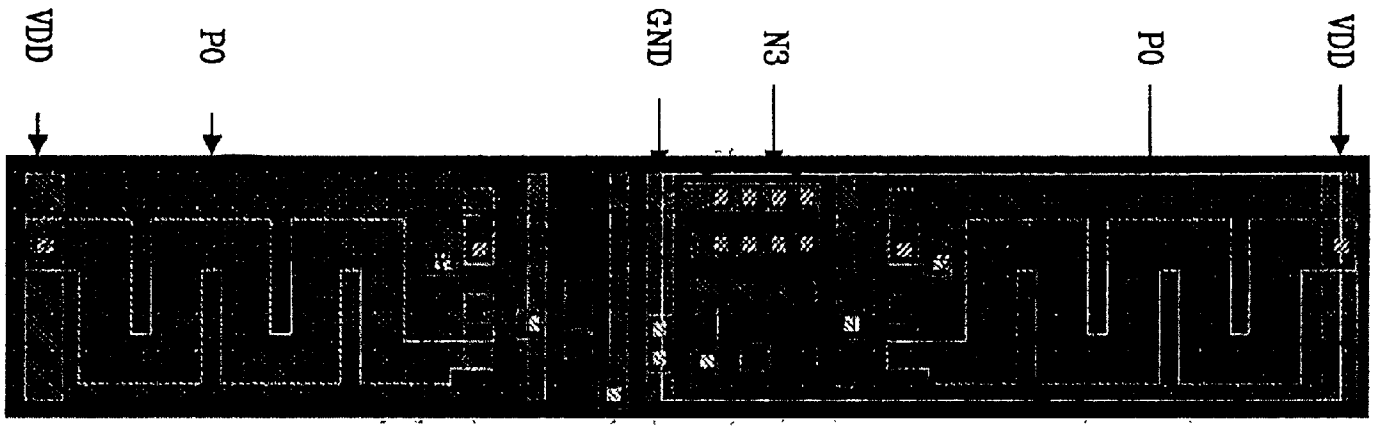
FIG. 9 is a layout illustrating the third embodiment of the present invention.

Also, the driving current of the transistors N2 and N3 in the amplifier makes not only the emitting pixel OEL emit lights, but also an adjacent emitting pixel OEL (not shown) emit lights, thereby decreasing the area of layout referring to FIG. 9.

As shown in FIG. 7 and FIG. 8, an operation of the third embodiment of the present invention will be described as follows.

When the scan signal of FIG. 7 is applied during a time period 't4' of FIG. 8 that is called as one scan time, the transistors P1 and P2 respectively are turned on, and the transistor N1 is turned off.

During a time period 't1' of FIG. 8, a column line to which $I_{out}$ is output is cleared, and data in a node 1 is cleared by Vramp signal during a time period 't2'.

Also, a voltage applied to the node 1 during a time period 't3' is determined.

A process of time period 't4' is repeated as the number of total scan lines during a time period 't5' of FIG. 8.

FIG. 9 is a layout illustrating FIG. 7.

As shown in FIG. 9, the driving transistor PO of FIG. 7 is snake-shaped, so that it is useful to form a device having a long channel within a small pixel, and to enlarge the capacitor Cs of FIG. 7.

As described above, the driving circuit of the active matrix method in the display device according to the present invention has the following advantages.

First, it is possible to decrease the luminance deviation of the emitting pixels without regard to the deviation of the threshold voltages of the driving transistors, thereby improving uniformity of the luminance.

Furthermore, if the amplifier having the high transimpedance is used in the deviation compensator of the present invention, it is possible to obtain desired luminance since a margin of the control voltage according to the level of the driving current is large.

Finally, the transistor snake-shaped is used in the present invention, thereby decreasing the area of layout. Also, capacitance of the capacitor for storing electric charges can be improved.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A driving circuit of an active matrix method in a display device comprising:

a first switch connected to data and scan lines to switch an externally applied control voltage;

a driving unit storing the control voltage by switching of the first switch, and making the display device emit lights by the stored control voltage;

a second switch switching a current applied to the display device by the control voltage applied from the driving unit; and a deviation compensator detecting the current applied to the display device by switching of the second switch, and controlling the control voltage, thereby compensating luminance deviation of the display device according to deviation of the threshold voltages of the driving units, wherein the deviation compensator comprises:

a converter converting the current applied to the display device to a voltage, a comparator comparing the voltage value converted by the converter with a reference voltage value, and a sample & hold circuit (S & H circuit) receiving an external ramp voltage, and outputting a certain ramp voltage to the data line according to result of the comparator.

2. The driving circuit of the active matrix method in the display device as claimed in claim 1, wherein the S & H circuit outputs the ramp voltage value constantly maintained to the data line when the converted voltage value is same as or lower than the reference voltage value, and the S & H circuit bypasses and outputs the external input ramp voltage value to the data line when the converted voltage value is higher than the reference voltage value.

3. The driving circuit of the active matrix method in the display device as claimed in claim 1, wherein the deviation compensator comprises:

a transimpedance amplifier converting the current applied to the display device to a voltage amplified, a comparator comparing the voltage converted by the transimpedance amplifier with a reference voltage, and a S & H circuit receiving an external ramp voltage, and outputting a certain ramp voltage to the data line according to result of the comparator.

4. The driving circuit of the active matrix method in the display device as claimed in claim 3, wherein the S & H circuit outputs the ramp voltage value constantly maintained to the data line when the converted voltage value is same as or lower than the reference voltage value, and the S & H circuit bypasses and outputs the externally input ramp voltage value to the data line when the converted voltage value is higher than the reference voltage value.

5. The driving circuit of the active matrix method in the display device as claimed in claim 1, wherein the second switch comprises:

a first transistor formed between the driving unit and the display device to switch the current applied to the display device, and a second transistor formed between the driving unit and the deviation compensator to switch the current applied to the deviation compensator.

6. The driving circuit of the active matrix method in the display device as claimed in claim 5, wherein the first and second transistors are PMOS transistors, and are driven by different control signals.

7. The driving circuit of the active matrix in the display device as claimed in claim 5, wherein the first transistor is an NMOS transistor, and the second transistor is a PMOS transistor, and the first and second transistors are driven by an equal control signal.

8. The driving circuit of the active matrix in the display device as claimed in claim 1, further comprising an amplifier formed between the second switch and the deviation compensator, which amplifies the applied current by switching of the second switch, and inputs the amplified current to the deviation compensator.

9. The driving circuit of the active matrix in the display device as claimed in claim 8, wherein the amplifier comprises:

a third transistor having a gate connected to an output terminal of the second switch, and outputting the current amplified by a voltage difference between gate and source to the deviation compensator, and a fourth transistor connected to gate and ground of the third transistor, and controlling the voltage difference by an externally applied control signal.

10. The driving circuit of the active matrix method in the display device as claimed in claim 9, wherein the third and fourth transistors are NMOS transistors.

11. A driving circuit of an active matrix method in a display device comprising:

a switching unit connected to data and scan lines, and switching an externally applied control voltage;

a driving unit storing the control signal by switching of the switching unit, and making the display device emit lights by the voltage stored;

a deviation compensator detecting a current applied to the display device, and controlling the control voltage, thereby compensating luminance deviation of the display device according to deviation of threshold voltages of the driving unit;

a first transistor formed between the driving unit and the display device to switch the current applied to the display device; and a second transistor formed between the driving unit and the deviation compensator to switch the current applied to the deviation compensator, wherein the deviation compensator comprises:

a converter converting the current applied to the display device to a voltage, a comparator comparing the voltage value converted by the converter with a reference voltage value, and a S & H (sample and hold) circuit receiving an external ramp voltage, and outputting a certain ramp voltage to the data line according to result of the comparator.

12. The driving circuit of the active matrix method in the display device as claimed in claim 11, wherein the S & H circuit outputs the ramp voltage value constantly maintained to the data line when the converted voltage value is same as or lower than the reference voltage value, and the S & H circuit bypasses and outputs the externally input ramp voltage value to the data line when the converted voltage value is higher than the reference voltage value.

13. The driving circuit of the active matrix method in the display device as claimed in claim 11, wherein the deviation compensator comprises:

a transimpedance amplifier converting the current applied to the display device to an amplified voltage, a comparator comparing the voltage converted by the transimpedance amplifier with a reference voltage value, and a S & H circuit receiving a ramp voltage and outputting a certain ramp voltage according to result of the comparator.

14. The driving circuit of the active matrix method in the display device as claimed in claim 11, wherein the switching unit, and the first and second transistors are PMOS transistors, and are respectively driven by different control signals.

15. The driving circuit of the active matrix method in the display device as claimed in claim 11, wherein the switching unit and the second transistor are PMOS transistors, and the first transistor is an NMOS transistor and the switching unit, the first and second transistors are driven by an equal control signal.

16. The driving circuit of the active matrix method in the display device as claimed in claim 11, further comprising an amplifier formed between the second transistor and the deviation compensator, which amplifies the applied current by switching of the second transistor, and inputs the amplified current to the deviation compensator.

17. The driving circuit of the active matrix method in the display device as claimed in claim 16, wherein the amplifier comprises:

a third transistor having a gate connected to an output terminal of the second transistor, and outputting the current amplified by a voltage difference between the gate and source to the deviation compensator, and a fourth transistor connected to a gate and ground of the third transistor, and controlling the voltage difference by an externally applied control signal.

18. The driving circuit of the active matrix method in the display device as claimed in claim 17, wherein the third and fourth transistors are NMOS transistors.

* * * * *